US006712032B2

(12) United States Patent
Uhl et al.

(10) Patent No.: US 6,712,032 B2
(45) Date of Patent: Mar. 30, 2004

(54) METHOD FOR HEATING UP AN ELECTRICAL HEATING ELEMENT, IN PARTICULAR A GLOW PLUG FOR AN INTERNAL COMBUSTION ENGINE

(75) Inventors: Günther Uhl, Helmstadt-Bargen (DE); Olaf Toedter, Haupersweiler (DE); Heinz-Georg Schmitz, Kirchberg-Murr (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 10/256,204

(22) Filed: Sep. 27, 2002

(65) Prior Publication Data

US 2003/0127450 A1 Jul. 10, 2003

(30) Foreign Application Priority Data

Sep. 27, 2001 (DE) ..... 101 47 675

(51) Int. Cl.[7] ..... F02N 17/02

(52) U.S. Cl. ..... 123/145 A; 123/179.6; 219/264

(58) Field of Search ..... 219/202, 205, 219/209, 264, 260; 123/179.6, 145 A

(56) References Cited

U.S. PATENT DOCUMENTS 4,368,617 A * 1/1983 Fukuda ..... 60/790
4,607,153 A * 8/1986 Ang et al. ..... 219/497
4,815,431 A * 3/1989 Yorita et al. ..... 123/196 AB
4,934,349 A * 6/1990 Demizu ..... 123/179.21
4,939,347 A * 7/1990 Masaka et al. ..... 219/492
6,635,851 B2 * 10/2003 Uhl ..... 219/270

FOREIGN PATENT DOCUMENTS

| | | | | |
|---|---|---|---|---|
| DE | 2123059 | | 11/1971 | |
| DE | 32 02 825 C2 | | 7/1972 | |
| DE | 38 05 996 C3 | | 6/1999 | |
| JP | 46067 | * | 3/1982 | ..... F02P/19/02 |
| JP | 39043 | * | 2/2002 | ..... F02P/19/02 |
| JP | 120932 | * | 4/2003 | ..... F23Q/07/22 |

* cited by examiner

*Primary Examiner*—Mahmoud Gimie
*Assistant Examiner*—Hai Huynh
(74) *Attorney, Agent, or Firm*—Nixon Peabody LLP; David S. Safran

(57) ABSTRACT

Method for heating an electrical heating element, for example, a glow plug for an internal combustion engine, from an initial temperature to the operating temperature. In order to prevent the heating element from overheating in cases where the initial temperature is higher than a set temperature that is normally taken as a basis, the actual initial temperature of the heating element is first determined, and an amount of electrical power depending on the level of the determined initial temperature is supplied to the heating element. In this way, the supplied amount of electrical power is reduced at higher initial temperatures, thus preventing the heating element from becoming overheated to a temperature at which damage can occur.

4 Claims, 1 Drawing Sheet

METHOD FOR HEATING UP AN ELECTRICAL HEATING ELEMENT, IN PARTICULAR A GLOW PLUG FOR AN INTERNAL COMBUSTION ENGINE

BACKGROUND OF THE INVENTION

1. Field of the Invention

The invention relates to a method for heating an electrical heating element, in particular a glow plug for an internal combustion engine, from an initial temperature to an operating temperature.

2. Description of Related Art

In order to rapidly heat an electrical heating element, such as a glow plug of a steel or ceramic design, or another type of heating element, such as a heater or heating flange, to an operating temperature, the heating element is usually operated for a limited time at a voltage higher than the operating or set voltage of the heating element. In this case, the set voltage of a heating element is the voltage at which the heating element has reached and maintains its operating parameters, in particular its desired or required surface temperature in a steady state. As a rule, the emitted thermal power of the heating element is equal to the consumed electrical power in this steady state.

Therefore, the heating process differs from the steady operating state in that a power that is higher than the power requirement in the steady state is supplied to the heating element for a limited time. This is necessary, since the heating element has mass which forms a thermal capacitance. This thermal capacitance must be taken into account during the heating process, and hence the specific amount of energy supplied to the heating element during the heating process. During the heating process, this provides an additional amount of energy increases the temperature of the heating element form its initial temperature to the operating temperature.

However, if the operating temperature determined by the design of the heating element is very high, and if there is only a very slight temperature difference relative to the melting point of the material of the heating element, e.g., the operating temperature for a glow plug is 1200° C. and the melting point is 1400° C., there is a danger that too much energy will be supplied to the heating element during the heating process, thereby causing the heating element to heat up to a temperature exceeding the operating temperature. If the melting point of the heating element is reached in the process, the heating element is destroyed. However, damage is usually already done to the heating element when the temperature of the heating element comes within its melting point range, i.e., when the reached heating element temperature is just 100° C., for example, under the melting point of the heating element.

The problem described above, namely that too much energy is supplied to the heating element during the heating process, can be caused by heating the heating element without taking into consideration the initial temperature of the heating element at the beginning of the heating process, i.e., the initial temperature that is higher than normal but under the operating temperature that may be a result of a recently operated heating element or an already high ambient or engine temperature. Since the energy required for heating depends on the temperature difference between the operating temperature and the initial temperature of the heating element, too much energy is then supplied to the heating element without considering the importance of the heating element initial temperature such that the heating element is brought to a temperature exceeding the operating temperature.

SUMMARY OF THE INVENTION

Therefore, a primary object of the present invention is to provide a method for preventing a heating element from overheating, or from heating to a temperature higher than its intended operating temperature, so as to avoid damaging or even destroying the heating element.

This object is achieved according to the invention by determining the initial temperature of the heating element and supplying electrical energy to the heating element for heating purposes at a level dependent on the determined initial temperature.

Therefore, in the method according to the invention, the initial temperature of the heating element is determined so that the temperature difference, and hence the electrical energy, required to bring the heating element from the determined initial temperature to the operating temperature can be determined using the given operating temperature. This makes it possible to avoid overheating and damaging the heating element.

The present invention will be explained in greater detail with a preferred example of a method for heating a heating element, e.g., a glow plug, in conjunction with the accompanying figures of the Drawings.

DETAILED DESCRIPTION OF THE INVENTION

Figure 1:
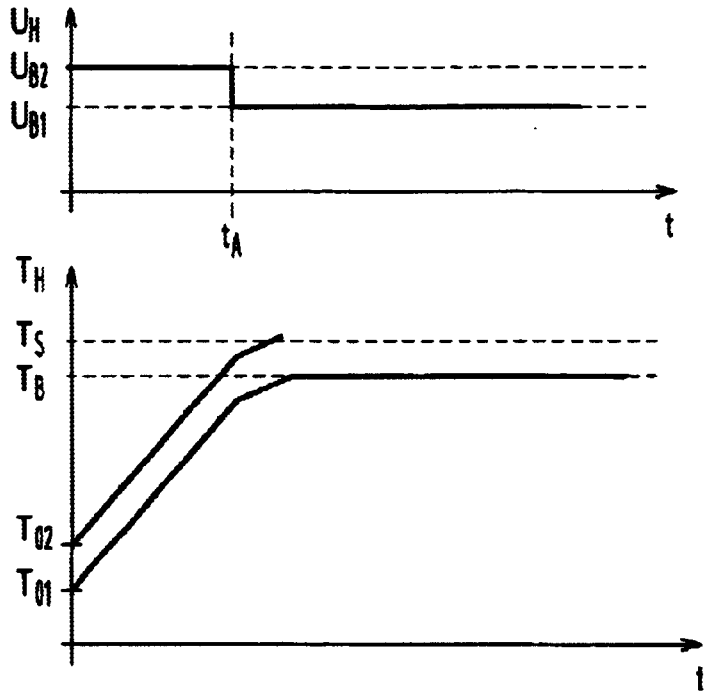
FIG. 1 is a diagram of the voltage applied to the heating element, and the temperature of the heating element as a function of time.

As shown on FIG. 1, a voltage $U_{B2}$, which is higher than a voltage $U_{B1}$ applied to the heating element in a steady state, is applied to the heating element when heating up an electrical heating element over a specific time $t_A$.

As additionally shown in FIG. 1, in cases where the initial temperature exceeds $T_{01}$, e.g. equals $T_{02}$, the heating element gets heated to the temperature $T_S$, which is above the operating temperature $T_B$ at the same level of supplied electrical power. If this temperature $T_B$ is close to or reaches the melting point of the material of the heating element, the heating element becomes damaged or destroyed.

In the method according to the present invention, overheating is prevented by determining the initial temperature of the heating element, and supplying the heating element with electrical power for heating purposes, wherein the level of power supplied depends on the determined initial temperature. Therefore, for example, when an initial temperature of $T_{02}$ is determined, a lower amount of electrical power is supplied to the heating element than if the initial temperature measures $T_{01}$. As a result, the temperature only increases to the operating temperature $T_B$ during the heating process, even when the initial temperature $T_{02}$ is higher than the temperature $T_{01}$.

Specifically, this means that, to heat up the heating element from its determined initial temperature to the operating temperature, the heating element is operated for a specific time at the higher operating voltage $U_{B2}$, after which the voltage is reduced to the operating voltage $U_{B1}$. In this case, the time for which the heating element is operated at the higher operating voltage $U_{B2}$ is determined as a function of the determined initial temperature. In other words, the voltage $U_{B2}$ at a higher initial temperature $T_{02}$ is only supplied for a period of time as if the initial temperature were at the set value $T_{01}$. Therefore, the time during which the higher voltage $U_{B2}$ is applied is selected in such a way as to prevent a thermal overload of the heating element.

It is also possible to determine the amount of electrical power supplied to the heating element for heating purposes as a function of the initial temperature by selecting the appropriate level of voltage $U_{B2}$.

The two voltages $U_{B1}$ and $U_{B2}$ can be achieved by selecting the vehicle electrical system voltage as the higher voltage $U_{B2}$, e.g., for a glow plug, and generating the operating voltage $U_{B1}$, which is below this voltage, by means of modulating, e.g., pulse-width modulating, the voltage $U_{B2}$. This effectively reduces the active voltage, which is the effective voltage on the heating element, from $U_{B2}$ to $U_{B1}$.

Figure 2:
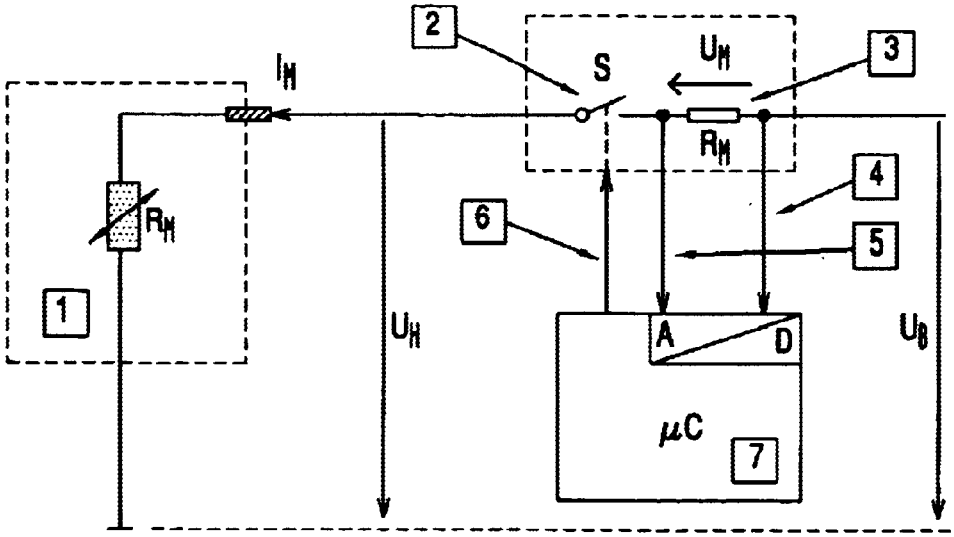
FIG. 2 is the circuit diagram of an electrical circuit configuration for heating an electrical heating element in an embodiment of the present invention.

FIG. 2 shows a circuit diagram of a circuit configuration for executing the method according to the invention. FIG. 2 shows an electrical heating element 1. Almost all electrical heating elements have a temperature-dependent resistance based on their physical properties, for example, of the resistance temperature coefficient of their materials and/or their internal structure. This applies to metallic heaters, glow plugs with heater and control coils, heaters with cold heating elements PTC, and similar electrical heating elements.

In order to determine the initial temperature of the heating element 1, its electrical resistance $R_T$ is determined before the heating process begins, and from that the initial temperature is determined via the temperature coefficient of the material of the heating element. To determine the electrical resistance $R_T$, the current $I_K$ and voltage $U_K$ of the heating element are measured, and thus resistance $R_T$ is calculated.

The circuit configuration shown on FIG. 2 further comprises a microprocessor 7 with an analog/digital converter connected to voltage taps 4 and 5 on either side of a measuring resister 3, which is connected with the heating element 1 via a switch 2. The microprocessor 7 applies a control signal 6 to the switch 2, which opens and closes the switch 2, thereby, the operating voltage $U_B$ is applied to measuring resistor 3.

What is claimed is:

1. A method for heating an electric element for an internal combustion engine, from an initial temperature to an operating temperature, comprising the steps of:

determining the initial temperature of the heating element;

supplying electrical power to the heating element for heating purposes, wherein the level of the electrical power depends on the determined initial temperature; and further comprising the step of applying a voltage higher than the operating voltage to the heating element before the operating temperature is reached.

2. The method according to claim 1, wherein a constant power is applied to the heating element over a period of time depending on the initial temperature.

3. The method according to claim 1, wherein a power depending on the initial temperature is applied to the heating element over a constant period of time.

4. The method according to claim 1, wherein the heating element that is heated is a glow plug.

* * * * *